US007280018B2

(12) United States Patent
Mueller

(10) Patent No.: US 7,280,018 B2
(45) Date of Patent: Oct. 9, 2007

(54) HOUSING INCLUDING STRENGTHENING MEMBER AND ELECTRICAL SWITCHING APPARATUS EMPLOYING THE SAME

(75) Inventor: Robert W. Mueller, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 151 days.

(21) Appl. No.: 10/854,386

(22) Filed: May 26, 2004

(65) Prior Publication Data

US 2005/0264388 A1 Dec. 1, 2005

(51) Int. Cl.
*H01H 13/04* (2006.01)
*H01H 9/02* (2006.01)

(52) U.S. Cl. ..... 335/202; 200/303

(58) Field of Classification Search ..... 335/6–46, 335/201–202; 200/293–211
See application file for complete search history.

(56) References Cited

U.S. PATENT DOCUMENTS 3,988,557 A * 10/1976 Francke et al. ..... 200/314
5,302,788 A * 4/1994 Link et al. ..... 200/401

OTHER PUBLICATIONS

Pennsylvania State University, Blast-Resistant Design and Construction, "Steel Stuff", http:\\www.engr.psu.edu/ae/steelstuff/sblast.htm, Mar. 3, 2004, 1 p.

* cited by examiner

*Primary Examiner*—Ramon M. Barrera
(74) *Attorney, Agent, or Firm*—Martin J. Moran

(57) ABSTRACT

A circuit breaker includes a molded base and cover, with at least one of the base and cover being a molded member including a pair of end walls, a pair of side walls, and an opening between the side walls. A strengthening member engages the base and cover between the side walls at the opening, engages at least one of the side walls and is an interior wall of the molded member. The base and cover are made of a first material, such as glass polyester or a suitably high strength plastic, and the strengthening member is made of a second dissimilar material, such as aluminum or steel, which has greater strength than the first material. An operating mechanism coupled to separable contacts is structured to move the contacts between open and closed positions. A trip mechanism coupled to the operating mechanism is structured to actuate the operating mechanism.

3 Claims, 7 Drawing Sheets

HOUSING INCLUDING STRENGTHENING MEMBER AND ELECTRICAL SWITCHING APPARATUS EMPLOYING THE SAME

CROSS-REFERENCE TO RELATED APPLICATION

This application is related to commonly assigned U.S. patent application Ser. No. 10/733,145, filed Dec. 11, 2003, entitled "Slot Motor Including Legs Engaging Openings of Circuit Breaker Housing and Electrical Switching Apparatus Employing the Same".

BACKGROUND OF THE INVENTION

1. Field of the Invention

The present invention relates to electrical switching apparatus, such as, for example, circuit breakers and, more particularly, to circuit breakers including a molded case. The invention also relates to housings for electrical switching apparatus.

2. Background Information

Circuit breakers, such as molded case circuit breakers, include at least one pair of separable contacts. For example, a first contact is fixed within the molded case housing and a second movable contact is coupled to an operating mechanism. These separable contacts are in electrical communication with either the line or the load coupled to the circuit breaker. The operating mechanism moves the movable contact between a first, open position wherein the movable contact is spaced from the fixed contact, and a second, closed position wherein the fixed and movable contacts are in contact and electrical communication. The operating mechanism may be operated manually or by a trip mechanism.

The exterior case and, in particular, the back line end wall of the case, of molded case circuit breakers has typically been a weak link for case strength and a limiting factor in increasing the interrupting ratings of circuit breakers. Typically, the bases and covers of molded case circuit breaker housings are made of glass polyester or phenolic and are relatively very intricate. Hence, it is believed that it is not possible or practical to employ a relatively high strength and a relatively highly reinforced case material (e.g., epoxy resin glass filled; vinylester) due to the relatively poor flow characteristics and relatively high viscosity of that material.

There is room for improvement in electrical switching apparatus, such as circuit breakers, and in housings for such apparatus.

SUMMARY OF THE INVENTION

These needs and others are met by the present invention which includes a strengthening member made of a dissimilar and relatively high strength material within the electrical switching apparatus molded case. This structure greatly increases the structural integrity of the molded case.

For example, the molded case may employ two dissimilar materials (e.g., without limitation, glass polyester and steel; glass polyester and aluminum; glass polyester and vinylester or epoxy resin) in order that the molded case has suitably high strength areas, where needed, and in order that the case molds may still contain desired detailed internal features (e.g., without limitation, base and cover features for pivot points, locating features and bearing areas).

As one aspect of the invention, a housing for an electrical switching apparatus comprises: a first electrical switching apparatus housing portion; a second electrical switching apparatus housing portion, with at least one of the first and second electrical switching apparatus housing portions being a molded member including a first end wall, a second end wall, a pair of side walls, and an opening between the side walls; and a strengthening member engaging such at least one of the first and second electrical switching apparatus housing portions between the side walls at the opening, the strengthening member engaging at least one of the side walls and being an internal wall of the molded member, with such at least one of the first and second electrical switching apparatus housing portions being made of a first material, and with the strengthening member being made of a second dissimilar material, which has greater strength than the first material.

The opening may be a first opening. The first electrical switching apparatus housing portion may be a base including the first opening. The second electrical switching apparatus housing portion may be a cover including a second opening. The strengthening member may engage the base at the first opening and the cover at the second opening.

The molded member may further include an interior wall adjacent the internal wall. The strengthening member may be a conductor and the interior wall may be an insulator.

As another aspect of the invention, an electrical switching apparatus comprises: a base; a cover, with at least one of the base and the cover being a molded member including a first end wall, a second end wall, a pair of side walls, and an opening between the side walls; a strengthening member engaging such at least one of the base and the cover between the side walls at the opening, the strengthening member engaging at least one of the side walls and being an internal wall of the molded member, with such at least one of the base and the cover being made of a first material, and with the strengthening member being made of a second dissimilar material, which has greater strength than the first material; separable contacts; and an operating mechanism coupled to the separable contacts, the operating mechanism being structured to move the separable contacts between an open position and a closed position.

The base may be a molded base including the opening. The molded base may include an interior wall adjacent the internal wall. The strengthening member may be a conductor. The interior wall may be an insulator.

As another aspect of the invention, a circuit breaker comprises: a base; a cover, with at least one of the base and the cover being a molded member including a first end wall, a second end wall, a pair of side walls, and an opening between the side walls; a strengthening member engaging such at least one of the base and the cover between the side walls at the opening, the strengthening member engaging at least one of the side walls and being an internal wall of the molded member, with such at least one of the base and the cover being made of a first material, and with the strengthening member being made of a second dissimilar material, which has greater strength than the first material; separable contacts; an operating mechanism coupled to the separable contacts, the operating mechanism being structured to move the separable contacts between an open position and a closed position; and a trip mechanism coupled to the operating mechanism, the trip mechanism being structured to actuate the operating mechanism to open the separable contacts.

The opening may include at least one dovetailed recess. The strengthening member may include at least one dovetailed protrusion, which engages such at least one of the base and the cover at such at least one dovetailed recess.

The strengthening member may include a generally I-shaped cross-section.

The first end wall may be a line end wall. The second end wall may be a load end wall. The opening may be proximate the line end wall. The strengthening member may bridge the side walls at the opening proximate the line end wall.

The base may be a molded base including the opening. The molded base may include an interior wall adjacent the internal wall. The strengthening member may be a conductor. The interior wall may be an insulator. The separable contacts may draw an arc proximate the interior wall.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the term "strength" shall expressly include, but not be limited by, tensile strength; shear strength; load-carrying capacity strength; impact resistance; flexural strength; and/or strength to resist explosion.

The invention is disclosed in connection with circuit breaker housings, although a wide range of electrical switching apparatus and housings therefor may be employed.

Figure 1:
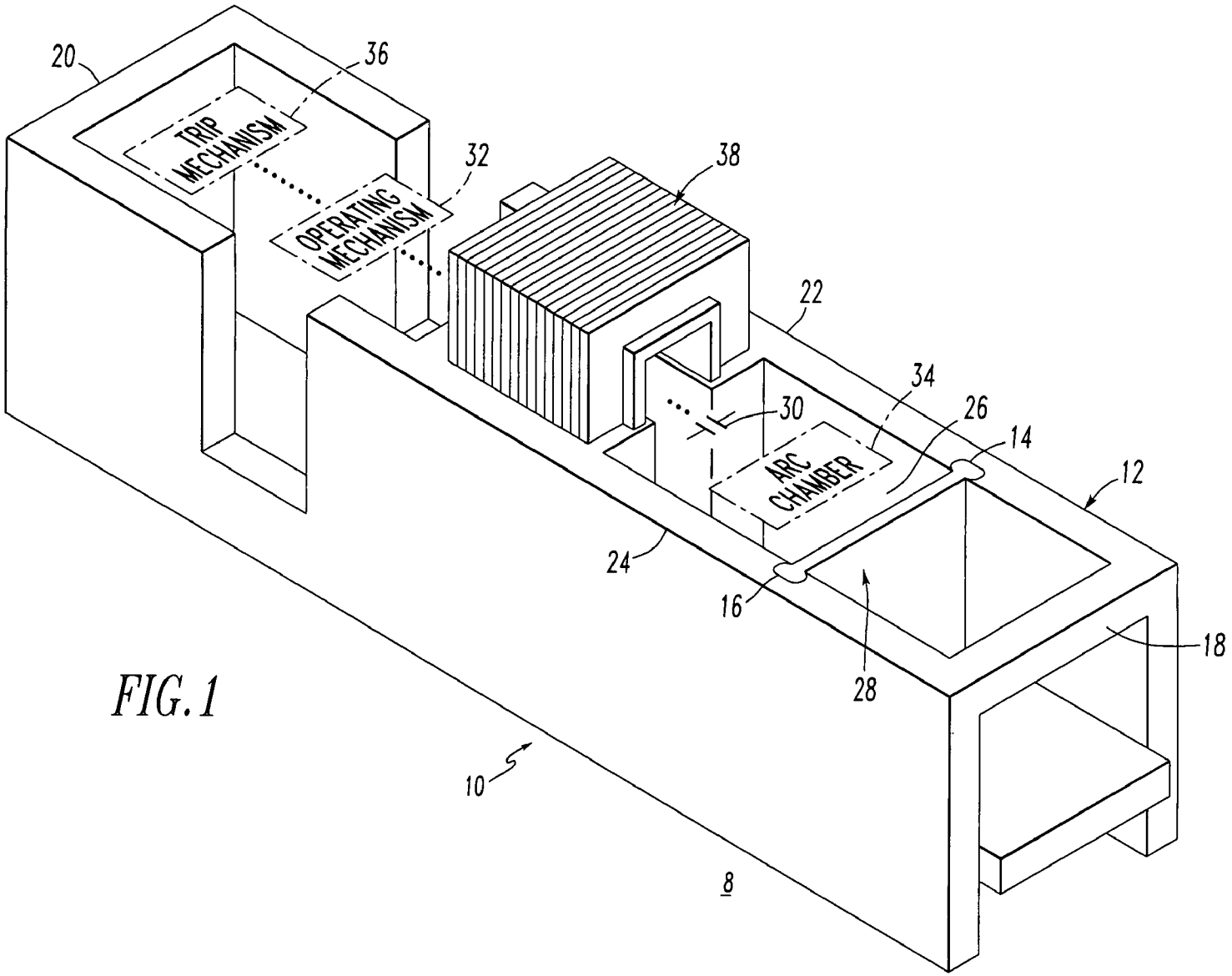
FIG. 1 is simplified isometric view of a circuit breaker, with the cover removed for convenience of illustration, including a circuit breaker housing having a base with an opening and a strengthening member in accordance with the present invention.

Referring to FIG. 1, an electrical switching apparatus, such as a single pole circuit breaker 8, and a molded housing 10 are shown. The molded housing 10 includes a first housing portion, such as molded base 12, with first and second recesses 14, 16 molded therein. Although a single pole circuit breaker 8 is shown, the invention is applicable to a wide range of electrical switching apparatus having a wide range of phase or pole counts. The molded housing 10 further includes a second housing portion, such as a molded cover (not shown).

The molded base 12 includes a first end wall 18, a second end wall 20, a pair of side walls 22, 24, and an opening 26 between the side walls 22, 24. A strengthening member 28 engages the molded base 12 between the side walls 22, 24 at the opening 28. In this example, the strengthening member 28 engages both of the side walls 22, 24 and is an internal wall of the molded base 12. The molded base 12 is made of a first material (e.g., without limitation, glass polyester; phenolic). The strengthening member 28 is made of a second dissimilar material (e.g., without limitation, steel; aluminum; thermoset plastic; vinylester epoxy resin; a suitable high strength/yield material), which has relatively greater strength than the first material.

The circuit breaker 8 further includes the molded cover (not shown), separable contacts 30, an operating mechanism 32, an arc chamber 34, a trip mechanism 36, and a slot motor assembly 38 disposed about such separable contacts.

Figure 9:
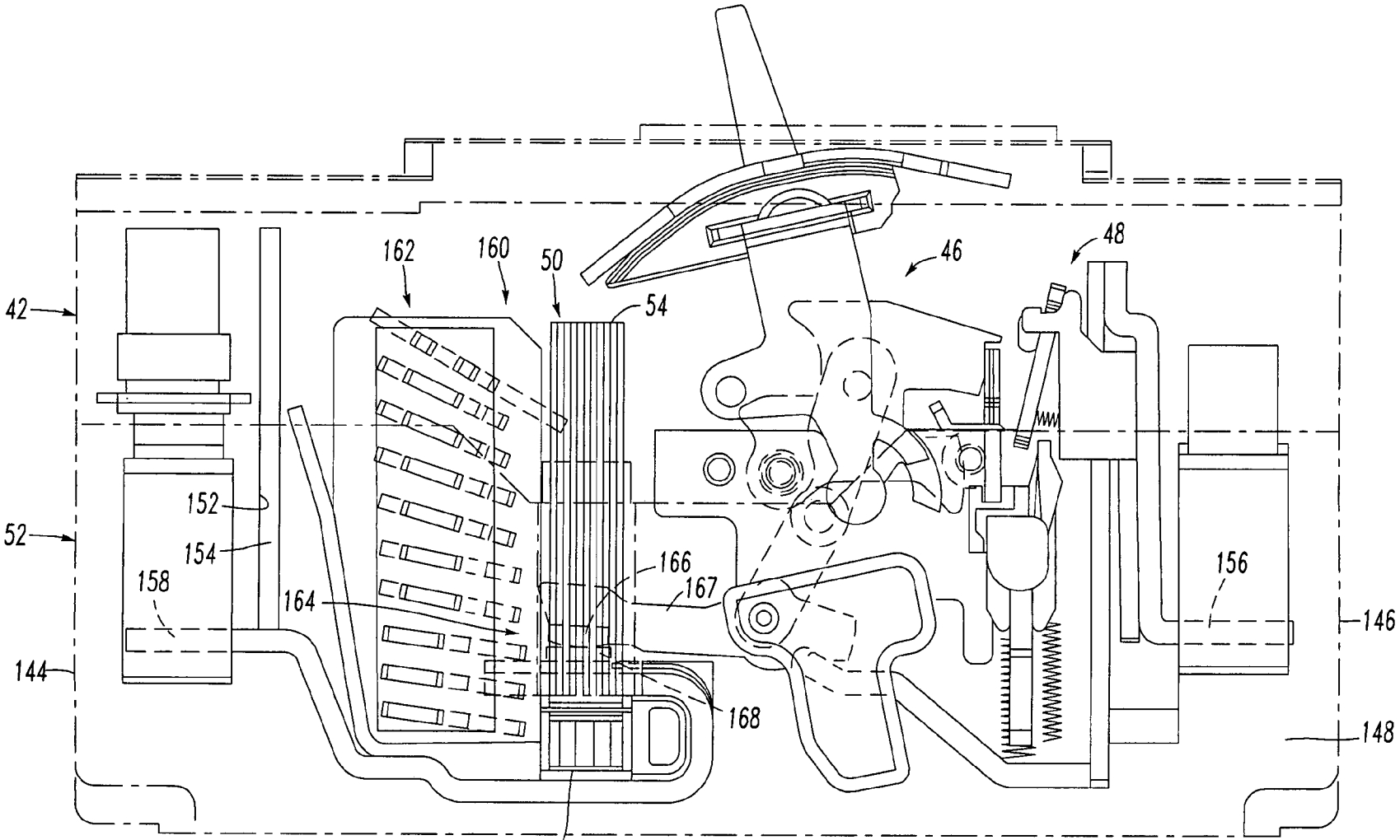
FIG. 9 is a longitudinal section of a side elevational view, partially broken away and partially in phantom, of an internal portion of a circuit breaker in accordance with another embodiment of the invention.

For example, the three-pole circuit breaker 40 of FIG. 9 includes a cover 42, separable contacts 44, an operating mechanism 46 coupled to the separable contacts 44 and structured to move such contacts between an open position (not shown) and a closed position, a trip mechanism 48 structured to actuate the operating mechanism 46 to trip open the separable contacts 44, a slot motor assembly 50 disposed about the separable contacts 44, and a base 52. The slot motor assembly 50 includes an upper slot motor assembly 54 and a lower slot motor assembly 56.

Figure 2:
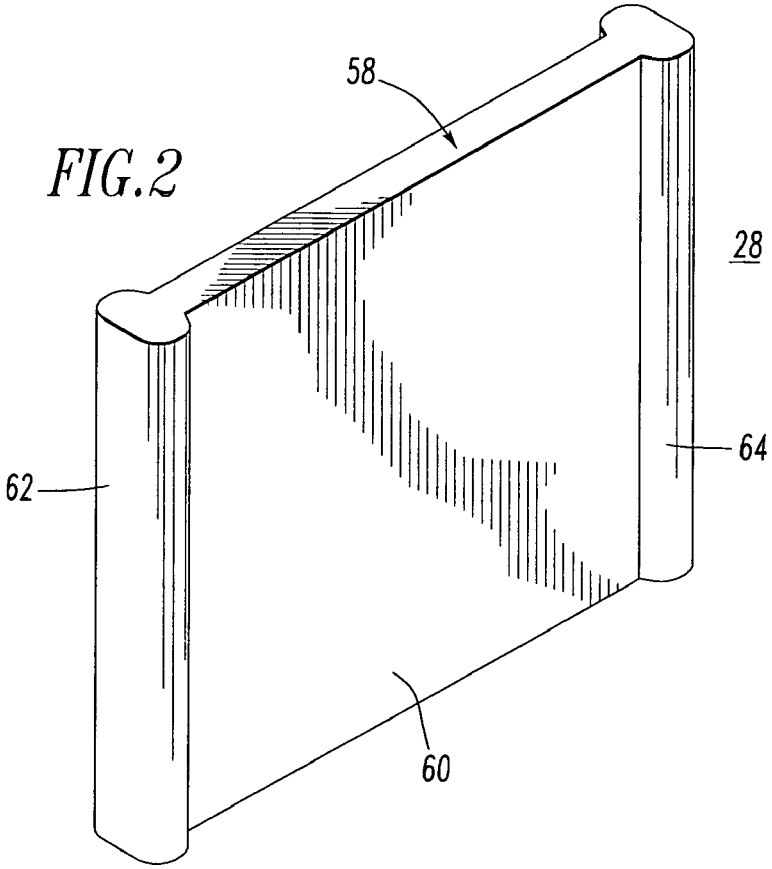
FIG. 2 is an isometric view of the strengthening member of FIG. 1.

FIG. 2 shows the strengthening member 28 of FIG. 1. The strengthening member 28 has a generally I-shaped cross-section 58 formed by a central planar portion 60 and two dovetailed protrusions 62, 64 at each end of the planar portion 60. As shown in FIG. 1, those protrusions 62, 64 engage the dovetailed recesses 14, 16, respectively, of the molded base 12. Although dovetailed protrusions 62, 64 and dovetailed recesses 14, 16 are shown, a wide range of mating and interlocking protrusions and recesses may be employed. For example, without limitation, one or both of the pairs 14, 62 and 16, 64 of the recesses and protrusions may have a suitable different mating shape.

As shown in FIG. 1, the strengthening member 28 interfaces with the circuit breaker molded base 12. This member 28 is disposed into the circuit breaker housing 10 near the line end wall 18. The dovetailed protrusions 62, 64 engage and capture the side walls 22, 24 at the dovetailed recesses 14, 16, respectively. The strengthening member 28 prevents the motion of the exterior walls 18, 22, 24, during extreme pressure "build-up" encountered during circuit interruption and, in turn, prevents the fracturing of the line end wall 18. The dovetail protrusions 62, 64 and dovetailed recesses 14, 16 in the strengthening member 28 and the molded base 12 are, preferably, optimized for maximizing holding strength. For example, these features provide relatively more surface area, are snug fitting and distribute the load evenly.

Figure 3:
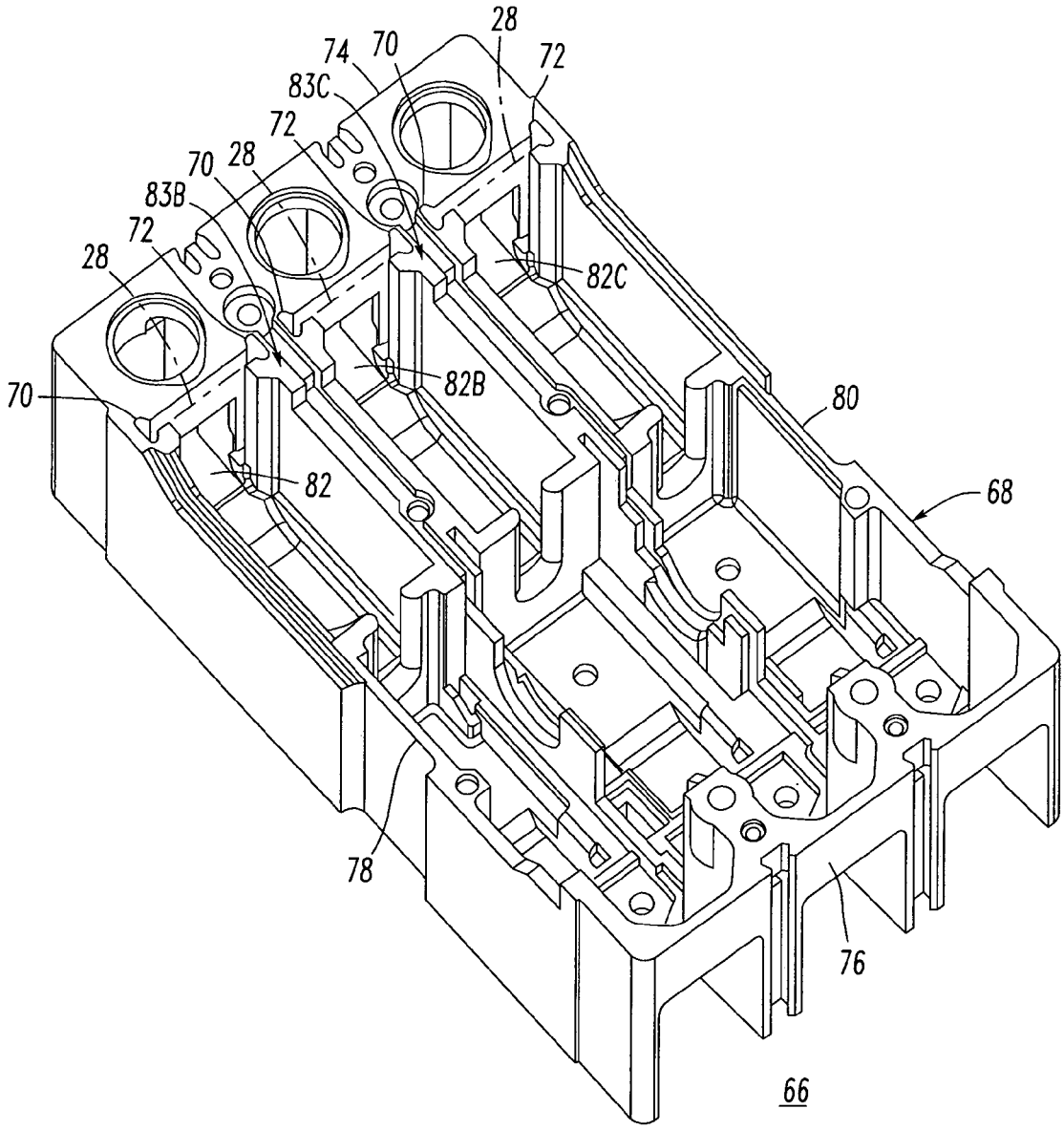
FIG. 3 is an isometric view of a circuit breaker base in accordance with another embodiment of the invention.

Referring to FIG. 3, another circuit breaker housing 66 is shown. The housing 66 includes a first housing portion, such as molded base 68, with first and second dovetailed recesses 70, 72 molded therein. The molded housing 66 further includes a second housing portion, such as a molded cover (not shown). The molded base 68 includes a first line end wall 74, a second load end wall 76, a pair of side walls 78, 80, and an opening 82 between the side walls 78, 80. The strengthening member 28 of FIG. 2 engages the molded base 68 between the side walls 78, 80 at the opening 82 proximate the first line end wall 74. The first strengthening member 28 engages the side wall 78 and an interior wall 83B of the molded base 68. For example, this bridges the exterior side wall 78 with the relatively thicker interior wall 83B. The second strengthening member 28 engages interior walls 83B, 83C and the third strengthening member 28 engages the interior wall 83C and the side wall 80. The molded base 68 is made of a material that is the same as or similar to the material of the molded base 12 of FIG. 1. As shown in FIG. 3 for the three poles, the three strengthening members 28 (shown in phantom line drawing) bridge the side walls 78, 80 at the openings 82, 82B, 82C proximate the line end wall 74. These strengthening members 28 prevent the motion of the outer wall 74 during extreme pressure "build-up" encountered during circuit interruption and, in turn, prevent the fracturing of that wall 74.

Figure 4:
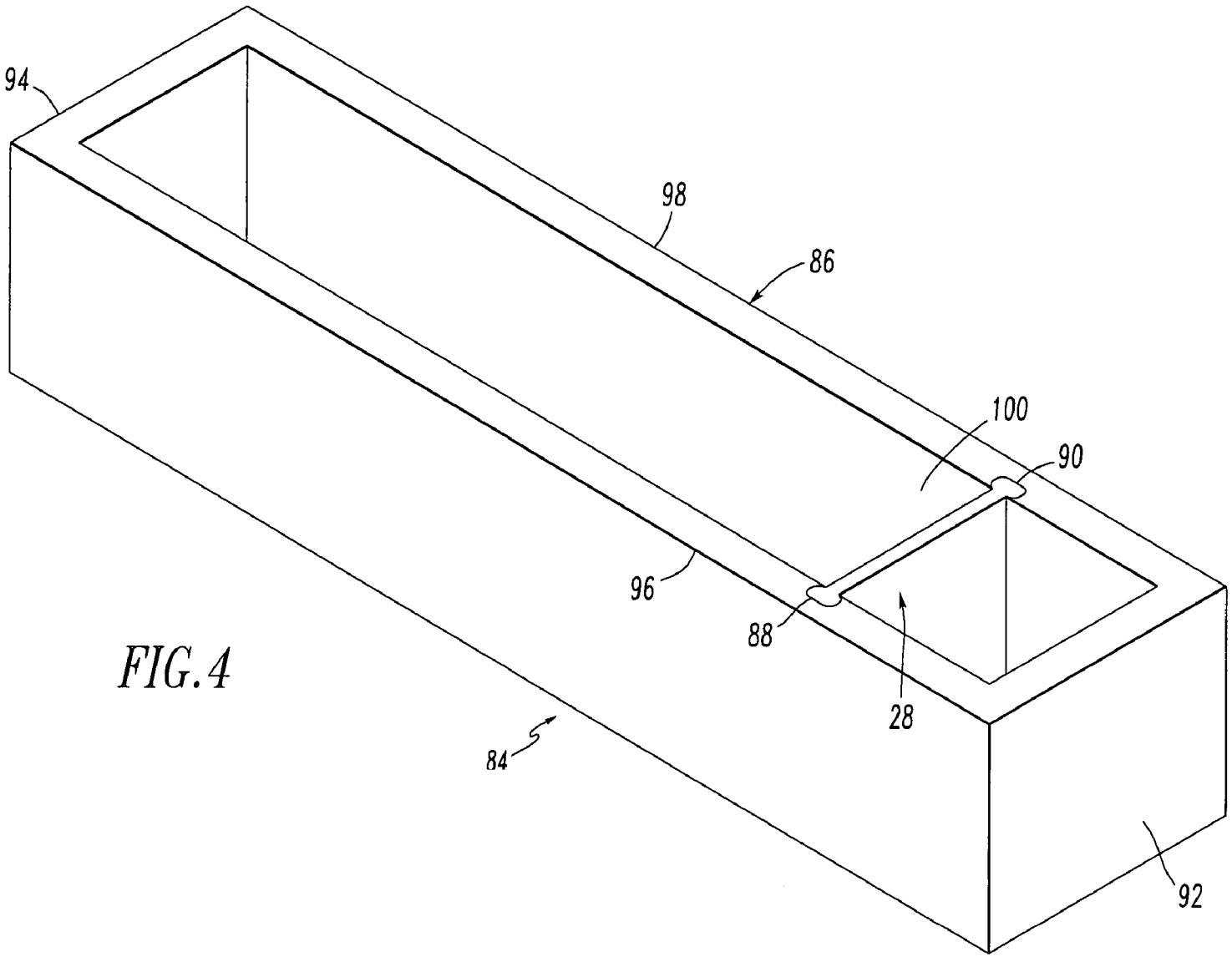
FIG. 4 is an isometric view of a circuit breaker cover in accordance with another embodiment of the invention.

Referring to FIG. 4, a molded housing 84 includes a first housing portion, such as molded cover 86, with first and second recesses 88,90 molded therein. The molded housing 84 further includes a second housing portion, such as a molded base (not shown). The molded cover 86 includes a first end wall 92, a second end wall 94, a pair of side walls 96, 98, and an opening 100 between the side walls 96, 98. The strengthening member 28 of FIG. 2 engages the molded cover 86 between the side walls 96, 98 at the opening 100. The molded cover 86 is made of a material that is the same as or similar to the material of the molded base 12 of FIG. 1.

Figure 5:
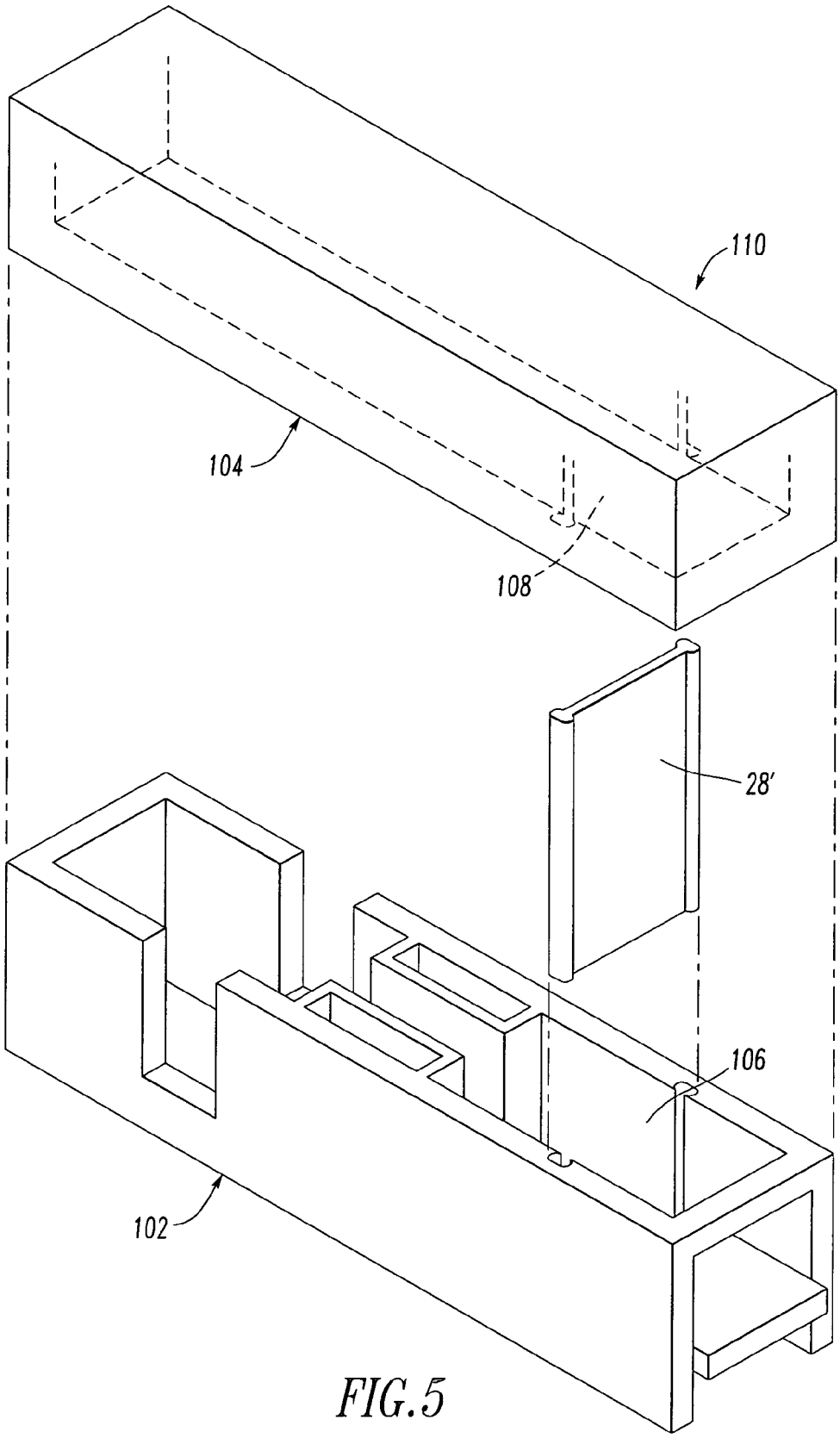
FIG. 5 is an exploded isometric view of a circuit breaker base and cover and another strengthening member in accordance with another embodiment of the invention.

FIG. 5 shows a circuit breaker molded base 102 and a circuit breaker molded cover 104 engaging a strengthening member 28'. The molded base 102 is similar to the molded base 12 of FIG. 1, the molded cover 104 is similar to the molded cover 86 of FIG. 4, and the strengthening member 28' is similar to the strengthening member 28 of FIG. 2, except that the member 28' is relatively taller, in order to engage both the molded base 102 at opening 106 and the molded cover 104 at opening 108. This structure provides an overall relatively stronger molded housing 110 by extending into both the base 102 and the cover 104, in order to lock the base and cover together.

Figure 6:
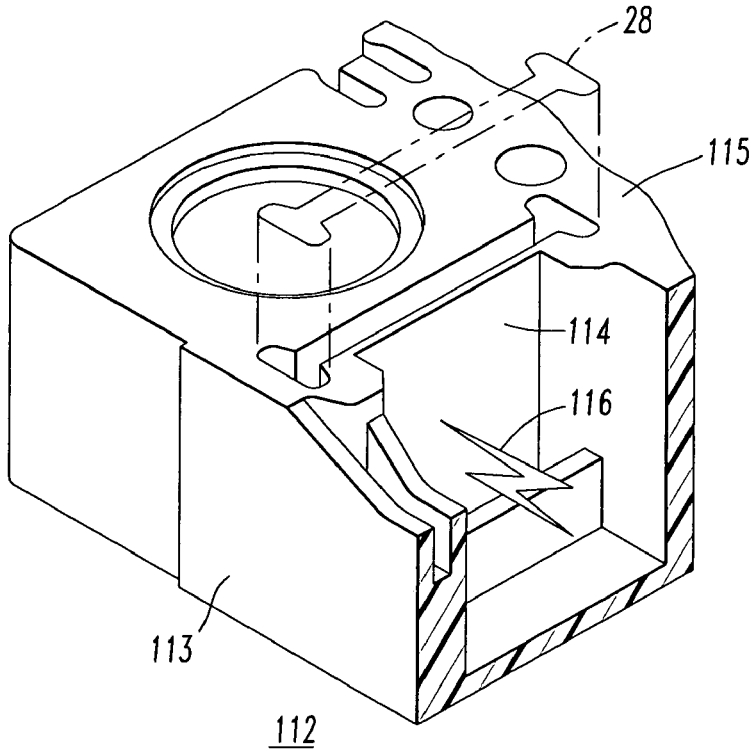
FIG. 6 is an isometric view of a portion of a circuit breaker molded base in accordance with another embodiment of the invention.

Referring to FIG. 6, a portion of a circuit breaker molded base 112 is shown. The strengthening member 28 (shown in phantom line drawing) engages a side wall 113 and an internal wall 115 of the molded base 112. The molded base 112 includes one or more relatively thin interior walls 114 (only one wall 114 is shown) adjacent the strengthening member 28 (shown in phantom line drawing). This structure adds additional strength to the molded base 112. Since the strengthening member 28 may be a conductor, the interior wall 114 is preferably an insulator and/or possesses dielectric properties. This wall 114, thus, insulates the conductive strengthening member 28 and the conductive internal wall formed thereby from internal circuit breaker structures (not shown). For example, the circuit breaker separable contacts (not shown) may draw an arc 116 proximate the insulated wall 114, which may also serve as an insulating shield for the strengthening member 28.

Figure 7:
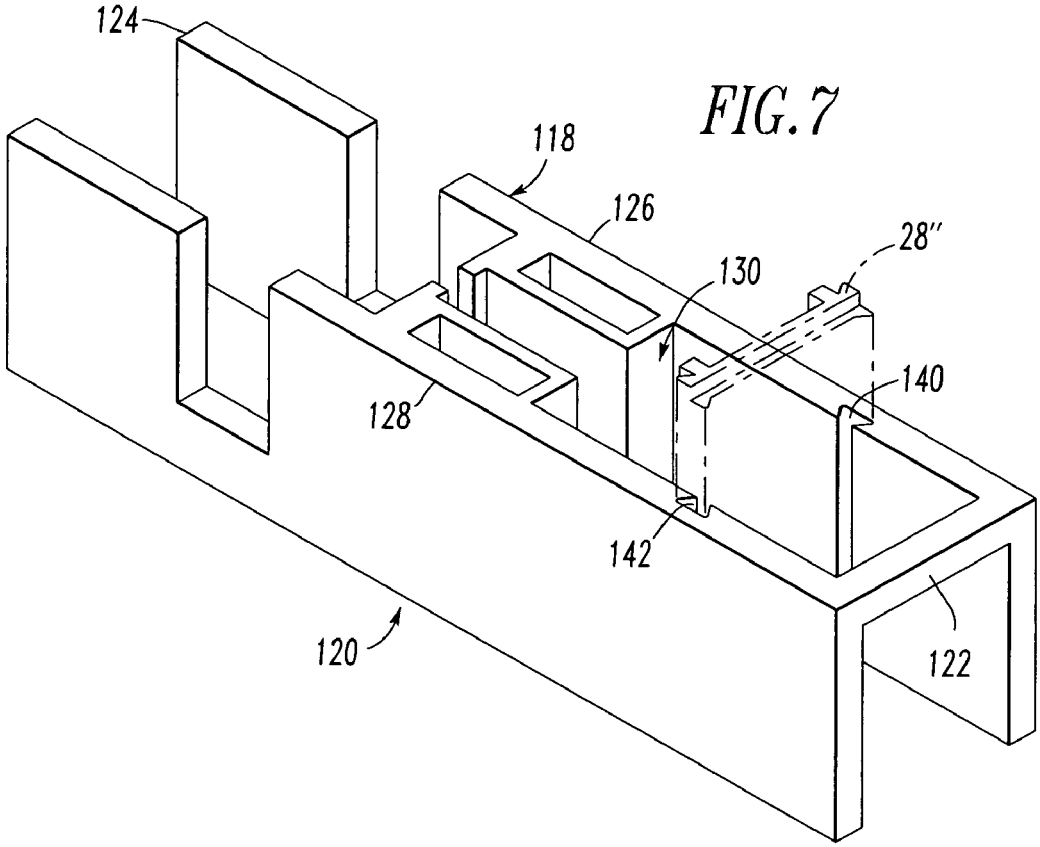
FIG. 7 is an isometric view of a circuit breaker base and strengthening member in accordance with another embodiment of the invention.
Figure 8:
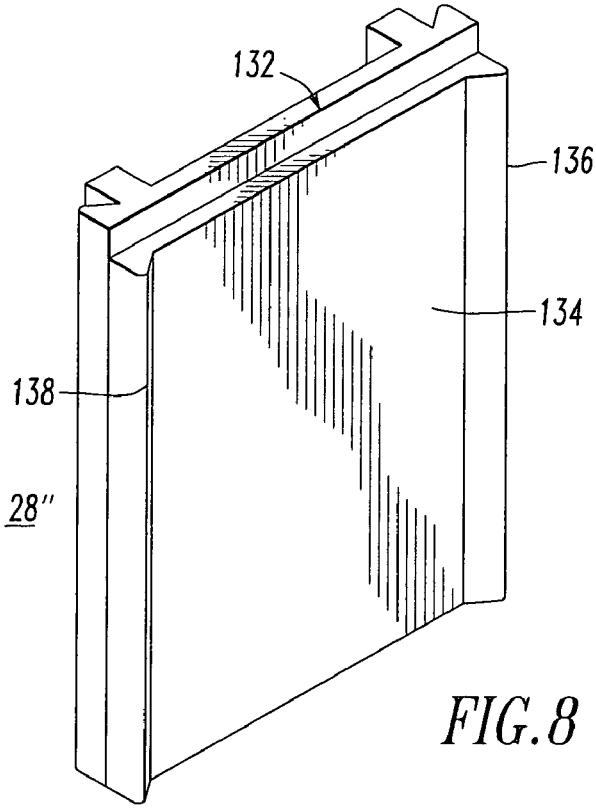
FIG. 8 is an isometric view of the strengthening member of FIG. 7.

FIGS. 7 and 8 show another circuit breaker molded base 118 and a strengthening member 28" therefor. The molded base 118 and a molded cover (not shown) form a circuit breaker housing 120. The molded base 118 includes a first end wall 122, a second end wall 124, a pair of side walls 126, 128, and an opening 130 between the side walls 126, 128. The strengthening member 28" engages the molded base 118 between the side walls 126, 128 at the opening 130.

The molded base 118 is made of a material that is the same as or similar to the material of the molded base 12 of FIG. 1. The strengthening member 28"0 is made of a material that is the same as or similar to the material of the strengthening member 28 of FIG. 2.

As best shown in FIG. 8, the strengthening member 28" has a generally I-shaped cross-section 132 formed by a central planar portion 134 and two dovetailed protrusions 136, 138 at each end of the planar portion 134. Those protrusions 136, 138 engage dovetailed recesses 140, 142, respectively, of the molded base 118 of FIG. 7.

Referring to FIG. 9, the three-pole circuit breaker 40 including the molded cover 42 and molded base 52 are shown. The cover 42 and the base 52 both include, as shown with the base 52, a first end wall 144, a second end wall 146, a first side wall 148, a second side wall (not shown) and an opening 152 between such side walls. A strengthening member 154 engages the base 52 and the cover 42 between the side walls at the opening 152. In this example, the strengthening member 154 engages the side wall 148 and an interior wall (not shown) parallel to the side wall 148. The molded cover 42 and base 52 are made of a material that is the same as or similar to the material of the molded base 12 of FIG. 1. The strengthening member 154 is made of a material that is the same as or similar to the material of the strengthening member 28 of FIG. 2.

The circuit breaker 40 includes a load terminal 156 and a line terminal 158. There is shown a plasma arc acceleration chamber 160 comprising the slot motor assembly 50 and an arc extinguisher assembly 162. Also shown is a contact assembly 164. Although not viewable in FIG. 9, each phase of the three-phase circuit breaker 40 has its own load terminal 156, line terminal 158, plasma arc acceleration chamber 160, slot motor assembly 50, arc extinguisher assembly 162, and contact assembly 164.

Each slot motor assembly 50 includes the separate first or upper slot motor portion or assembly 54, which is disposed proximate or above the first or movable contact 166 carried by movable contact arm 167 of operating mechanism 46, and the second or lower slot motor portion or assembly 56, which is disposed proximate or below the second or fixed contact 168.

Although various openings 26, 82, 100, 106, 108, 130, 152 are disclosed, a wide range of cross-sectional opening shapes may be employed.

Although various molded housings 10, 66, 84, 110, 120 and 42,52 are disclosed, a wide range of housings, bases and covers may be employed. These molded housings and the strengthening members 28, 28', 28", 154 cooperate to greatly increase the structural integrity of the molded housings. As a result, the molded housings may have suitably high strength areas, where needed, and may still contain desired detailed internal and/or external features.

In addition to increasing the strength of the molded housings, the disclosed strengthening members allow the base line end to be open, thereby helping to eliminate assembly issues with relatively complicated reverse loop configurations (e.g., the typical installation process requires "fishing" the line conductor into the base (due to the shape) at relatively extreme angles) and with molded-in slot motors that require the line conductor to be inserted from the line end (e.g., the "molded in" slot motor sits above the line conductor and makes it impossible to "fish" the line conductor into place; the only way to insert the line conductor, with a "molded in" slot motor, would be to remove the back wall of the base).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a base;

a cover, with at least one of said base and said cover being a molded member including a first end wall, a second end wall, a pair of side walls, and an opening between said side walls;

a strengthening member engaging said at least one of said base and said cover between said side walls at said opening, said strengthening member engaging at least one of said side walls and being an internal wall of said molded member, with said at least one of said base and said cover being made of a first material, and with said strengthening member being made of a second dissimilar material, which has greater strength than said first material;

separable contacts;

an operating mechanism coupled to said separable contacts, said operating mechanism being structured to move said separable contacts between an open position and a closed position;

a trip mechanism coupled to said operating mechanism, said trip mechanism being structured to actuate said operating mechanism to open said separable contacts; and wherein said opening includes at least one dovetailed recess; and wherein said strengthening member includes at least one dovetailed protrusion, which engages said at least one of said base and said cover at said at least one dovetailed recess.

2. The circuit breaker of claim 1 wherein said opening includes two dovetailed recesses; and wherein said strengthening member includes two dovetailed protrusions, which engage said at least one of said base and said cover at said two dovetailed recesses.

3. The circuit breaker of claim 2 wherein said strengthening member includes a generally I-shaped cross-section.

* * * * *